United States Patent [19]

Morishita

[11] Patent Number: 4,515,539

[45] Date of Patent: May 7, 1985

[54] SCROLL-TYPE HYDRAULIC MACHINE WITH TWO AXIALLY SPACED SCROLL MECHANISMS

[75] Inventor: Etsuo Morishita, Hyogo, Japan

[73] Assignee: Mitsubishi Denki Kabushiki Kaisha, Tokyo, Japan

[21] Appl. No.: 617,438

[22] Filed: Jun. 5, 1984

[30] Foreign Application Priority Data

Sep. 1, 1983 [JP] Japan ..... 58-162131

[51] Int. Cl.[3] ..... F01C 1/04; F01C 11/00; F01C 17/06

[52] U.S. Cl. ..... 418/55; 418/60; 418/142

[58] Field of Search ..... 418/55, 58, 60, 142

[56] References Cited

FOREIGN PATENT DOCUMENTS

| | | | |
|---|---|---|---|
| 57-303 | 1/1982 | Japan | 418/55 |
| 57-26205 | 2/1982 | Japan | 418/55 |
| 57-38690 | 3/1982 | Japan | 418/55 |

*Primary Examiner*—John J. Vrablik

*Attorney, Agent, or Firm*—Sughrue, Mion, Zinn, Macpeak & Seas

[57] ABSTRACT

A scroll-type hydraulic machine, particularly, a compressor, in which thrust flows acting on a pair of orbiting scrolls cancel one another, thereby improving the reliability of the machine. The hydraulic machine includes first and second fluid volume changing mechanisms, each of which has a stationary scroll and an orbiting scroll assembled together such that fluid introduced between the wraps of the two scrolls is reduced in volume and discharged. A crank mechanism including a crankshaft having an eccentric through-hole extending therethrough has a first crank portion at one end for rotatably supporting a shaft of the orbiting scroll of the first fluid volume changing mechanism and a second crank portion at the other end thereof rotatably supporting the orbiting scroll of the second fluid volume changing mechanism. A thrust-cancelling shaft is disposed in the eccentric through-hole supporting at the opposed ends thereof the orbiting scrolls of the first and second fluid volume changing mechanisms. The thrust forces exerted on the first and second orbiting scrolls cancel one another through the thrust-cancelling shaft.

5 Claims, 10 Drawing Figures

SCROLL-TYPE HYDRAULIC MACHINE WITH TWO AXIALLY SPACED SCROLL MECHANISMS

BACKGROUND OF THE INVENTION

This invention relates to a scroll-type hydraulic machine.

Before describing the present invention, the operating principles of a scroll-type hydraulic machine will be briefly explained.

FIGS. 1A to 1D show fundamental components of a scroll-type compressor, which is one application of a hydraulic machine, at successive operating angular positions. As shown in these figures, the compressor is composed of a stationary scroll 1 having a fixed center O and an orbiting scroll 2 having an orbiting point O'. Compression chambers 4 are formed between the stationary scroll 1 and the orbiting scroll 2, and a discharge port 3 is provided at a center portion of the stationary scroll 1. The wraps of the scrolls 1 and 2 may have the form of an involute or a combination of involutes and acrs. The two wraps have complementary (mirror image) configurations.

In operation, the stationary scroll 1 and the orbiting scroll 2 are interleaved as shown and the orbiting scroll 2 is made to orbit continuously with respect to the stationary scroll 1 from a starting position (0°) depicted in FIG. 1A through angular positions of 90° (FIG. 1B), 180° (FIG. 1C) and 270° (FIG. 1D), without charging its attitude with respect to the stationary scroll 1. With such orbital movement of the orbiting scroll 2, volumes of the compression chambers 4 are periodically reduced, and hence the intake fluid is compressed. The compressed fluid is discharged from the discharge port 3.

During this operation, the discharge between the center O and the point O' is constant and can be represented by:

$$OO' = \frac{p}{2} - t,$$

where p corresponds to the pitch of the wraps and t is the wall thickness of each wrap.

In order to minimize the thrust forces acting in a scroll-type hydraulic machine or compressor having a large capacity, a structure has been proposed in which the orbiting scrolls are arranged in a back-to-back relationship to cancel out the thrust forces acting thereon. Examples of such structure are disclosed in U.S. Pat. Nos. 801,182, 3,011,694 and 4,192,152. In order to facilitate an understanding of the background of the present invention, the structure having the back-to-back arranged orbiting scrolls will be described briefly with reference to FIG. 2, which shows schematically an example of such a structure as disclosed in U.S. Pat. No. 4,192,152.

In FIG. 2, a pair of stationary scrolls 1 having scroll wraps 5 which are complementary in shape are fixedly secured to each other by bolts 14 with the scroll wraps facing one another with a space therebetween. An orbiting scroll 2 is formed on opposite surfaces thereof with orbiting scroll wraps 6, which are of complementary shapes. The orbiting scroll 2 is disposed in the space between the stationary scrolls. A plurality of compression chambers 4 are formed between the stationary scroll wraps 5 and the scroll wraps 6. Discharge ports 3 for the compressed fluid (such as air) are formed at center portion of the stationary scrolls 1. Discharge tubes 15 are connected to respective ones of the ports 3. An intake port 16 is formed at suitable position at the periphery of one of the stationary scrolls 1, to which an intake pipe 17 is connected. An intake chamber 18 is formed around the intake port 16 in the space formed between the stationary scrolls 1. A crankshaft 7 having an eccentric portion is supported by bearings 9, 10 and 11 provided in the stationary scrolls 1 and driven through a coupling 12 by a driving source 13. The eccentric portion of the crankshaft 7 is supported by a bearing 8 provided in the orbiting scroll 2. A balance weight 19 is attached to the eccentric portion of the crankshaft 7 to balance the centrifugal forces acting on the orbiting scroll 2 during the operation of the machine.

In operation, the crankshaft 7 is rotated by the driving source 13, which may be an electric motor, internal combustion engine, turbine or the like. When the crankshaft 7 rotates, the orbiting scroll 2 is made to orbit through the bearing 8 due to the eccentric rotation of the eccentric portion thereof. Hence, compression occurs on both sides of the orbiting scroll. The pressure in the compression chambers 4 increases with their movements towards the center portion of the machine. The compressed fluid is discharged from the discharge ports 3 through the discharge tubes 15. At the same time, fluid intake occurs through the tube 17 and the intake port 16 to the intake chamber 18, which is then fed to the compression chambers 4. The centrifugal force acting on the orbiting scroll 2 which is generated during the operation thereof is statically as well as dynamically balanced by the balance weight 19 shown in FIG. 2.

Since the compression chambers 4 are formed symmetrically, that is, with a mirror-image relationship on opposite sides of the orbiting scroll 2, the pressure distributions in the compression chambers 4 on the two sides are similar, and thus there are no thrust forces acting on the orbiting scroll 2 as a whole. This construction is particularly effective when the operating speed of the orbiting scroll is low and the thrust load is large because, in such a case, it is very difficult to employ a thrust bearing.

Although the conventional structure as described above is advantageous due to the fact that no thrust forces are produced, there are still problems in actual practice. Particularly, it is impossible as a practical matter to manufacture the orbiting scroll 2 having the mirror-image scroll wraps 6 on the opposite sides thereof with a high precision, and it is very difficult to assemble the orbiting scroll with the stationary scroll 1 having the wraps 5 with precisely adjusted radial gaps between the orbiting scroll wraps 6 and the stationary scroll wraps 5 on the two sides of the orbiting scroll. Therefore, the conventional scroll-type machine manufactured without taking such matters as mentioned above into consideration has not been entirely satisfactory. Particularly, when the crank bearings 9, 10 and 11 supporting the crankshaft 7 are provided in the stationary scrolls 1, the position of one of the stationary scrolls relative to the other is determined by the positions of the bearings in the stationary scrolls 1 and the position of the orbiting scrolls 2 relative to the stationary scrolls is determined by its coupling to the crankshaft 7. Thus, very precise adjustment of the radial gaps between the orbiting scroll and the stationary scroll is impossible as a practical matter.

Another important problem resides in the driving system for the orbiting scroll. In FIG. 2, a single crank mechanism is shown. In a case where a plurality of crank mechanisms are provided, arranged equiangularly, the eccentric center of the respective crankshafts 7 of the plural mechanisms must be precisely determined, otherwise normal operation of the machine itself cannot be attained.

SUMMARY OF THE INVENTION

An object of the present invention is thus to provide a scroll-type hydraulic machine having a pair of interleaved stationary scroll wraps and orbiting scroll wraps in which the thrust load acting on the orbiting scroll is cancelled by causing it to act on opposite sides of the eccentric shaft, and in which the mechanical reliability of the machine is improved by minimizing the relative movement between the orbiting scroll and the eccentric shaft.

Another object of the present invention is to provide a scroll-type hydraulic machine having orbiting scrolls which are easily assembled with the stationary scrolls and in which gaps between the orbiting scrolls and the stationary scrolls are well sealed.

According to the present invention, the above objects are achieved by providing a scroll-type hydraulic machine comprising a first fluid volume changing mechanism including a first stationary scroll having a first scroll wrap, a first orbiting scroll having a second scroll wrap interleaved with the first scroll wrap and adapted to reduce the volume of introduced fluid and to discharge the fluid so compressed when the second scroll wrap is orbited with respect to the first scroll wrap, and a first orbiting scroll shaft provided on the orbiting scroll opposite the second scroll wrap; a second fluid volume changing mechanism provided separately from the first fluid volume changing mechanism, the second fluid volume changing mechanism including a second stationary scroll having a third scroll wrap, a second orbiting scroll having a fourth scroll wrap, the fourth scroll wrap being interleaved with the third scroll wrap and adapted to reduce the volume of introduced fluid and discharge it when the fourth scroll wrap is orbited with respect to the third scroll wrap, and a second orbiting scroll shaft provided on the second orbiting scroll opposite the fourth scroll wrap; and a crank mechanism including a crankshaft disposed at a center portion in a space defined between the first and second orbiting scrolls and rotated by driving means. The crankshaft has an eccentric through-hole extending therealong, and has at one end thereof a first crank portion, and at the outer end thereof a second crank portion. The first crank portion supports the first orbiting scroll rotatably through a first eccentric ring, and the second crank portion supports the second orbiting scroll rotatably through a second eccentric ring. A thrust-cancelling shaft extends through the eccentric through-hole and supports at one end thereof the first orbiting scroll and at the other end the second orbiting scroll to thus cause the thrust forces of the first and second orbiting scrolls to cancel by transmitting the thrust forces acting on the first and second scrolls to the thrust-cancelling shaft in opposite directions thereto.

DESCRIPTION OF THE PREFERRED EMBODIMENTS

Figure 1A:
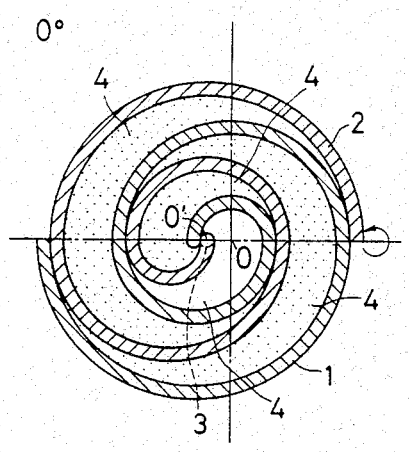
FIG. 1A PRIOR ART
FIGS. 1A to 1D taken together are a diagram showing a scroll-type hydraulic machine in successive operational positions, used for explaining the operating principles thereof.
Figure 1D:
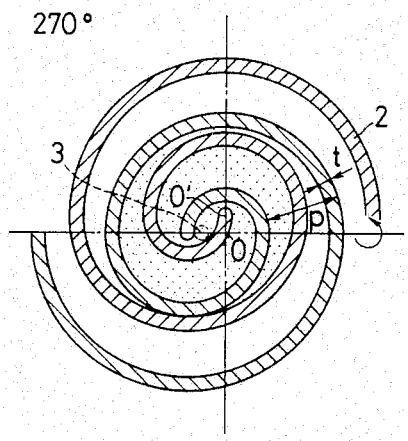
FIG. 1D PRIOR ART
Figure 1B:
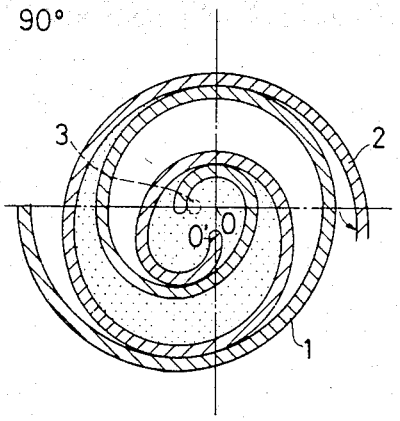
FIG. 1B PRIOR ART
Figure 1C:
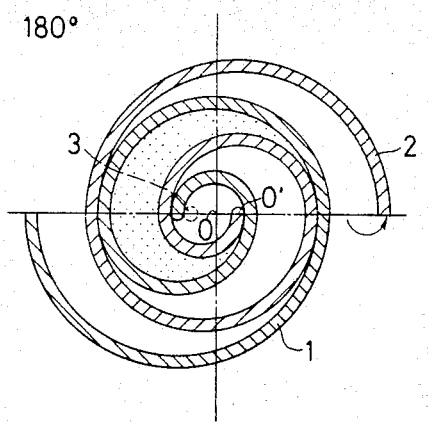
FIG. 1C PRIOR ART
Figure 2:
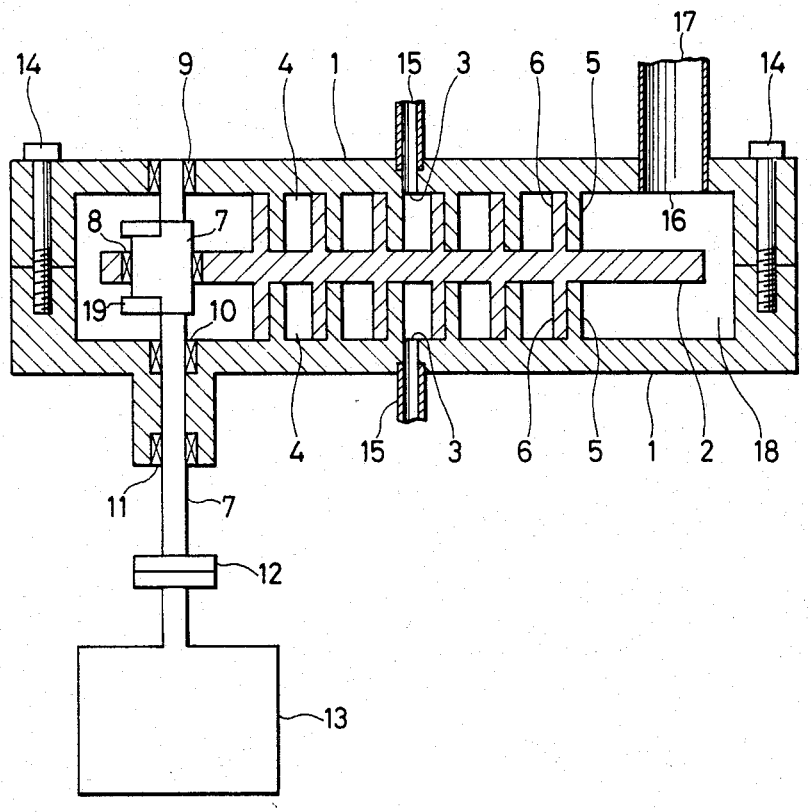
FIG. 2 PRIOR ART
FIG. 2 shows a cross section of a conventional scroll-type hydraulic machine.
Figure 3:
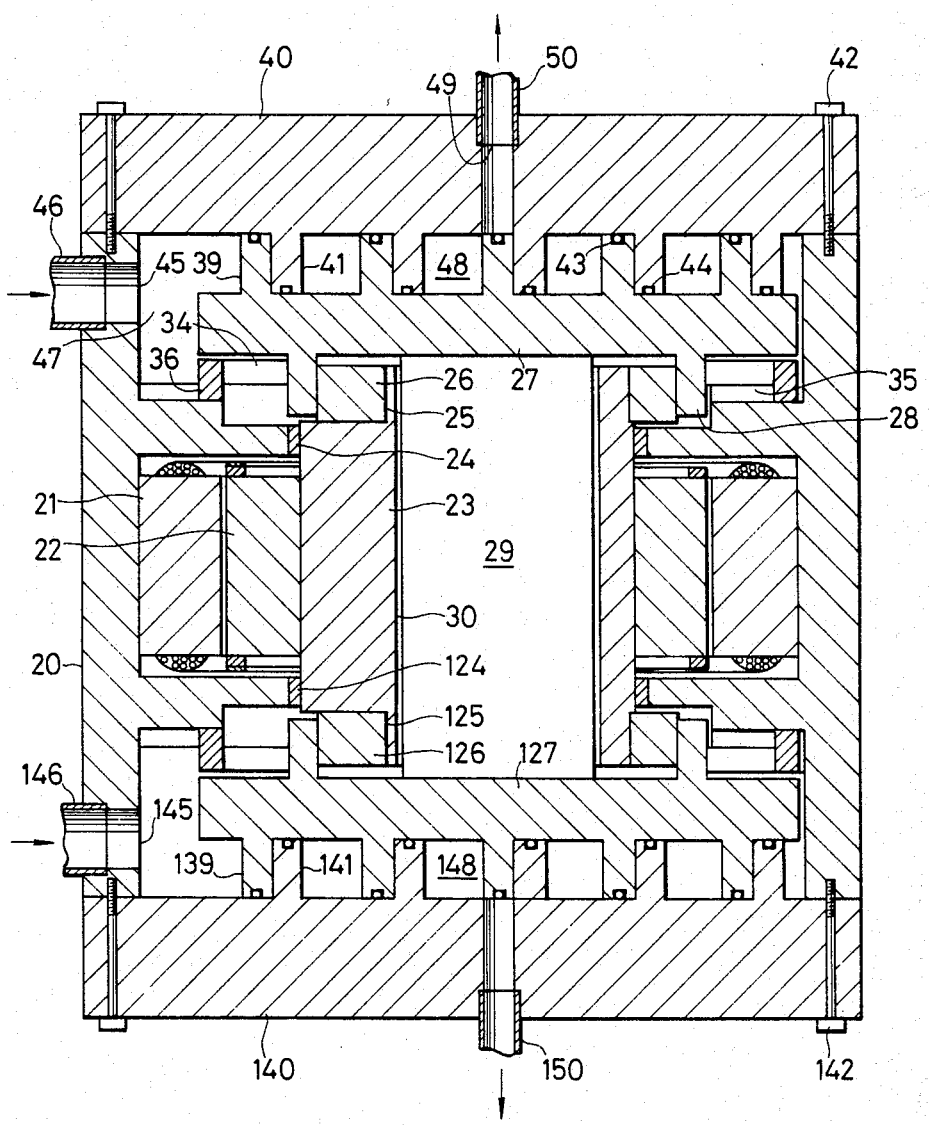
FIG. 3 shows a cross section of a preferred embodiment of a scroll-type hydraulic machine according to the present invention.
Figure 4:
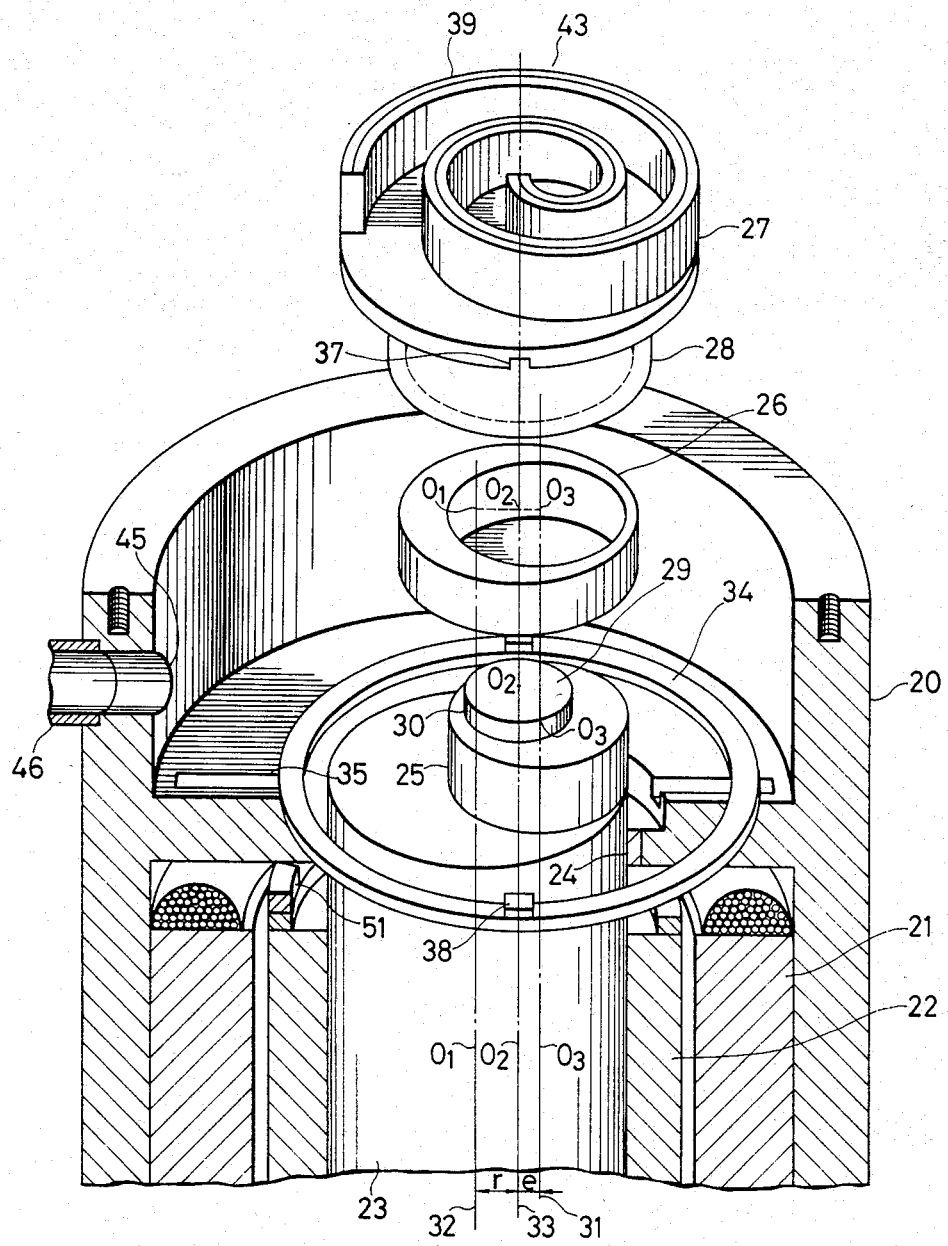
FIG. 4 is an enlarged view of a portion of the embodiment of FIG. 3 in a disassembled state.

In FIG. 3, which is a cross-sectional view of a preferred embodiment of a scroll-type hydraulic machine according to the present invention, and in FIG. 4, which is an enlarged perspective view of a portion of the machine of FIG. 3 in a disassembled state with important portions exaggerated, a housing 20 supports therein a stator 21 of an electric motor. A rotor 22 of the motor, which is driven by the stator 21, is fixedly secured to a crankshaft 23 provided at a center of the housing 20 and is rotated together with the crankshaft.

Since the scroll-type hydraulic machine of the present invention has a construction which is symmetrical vertically, only the upper half thereof will be further described in detail.

Bearings 24 and 124 are provided in the housing 20 for rotatably supporting opposite end portions of the crankshaft 23. A crank portion 25 is formed at one end of the crankshaft 23. A center $O_3$ (FIG. 4) of the crank portion 25 lies on a line 31 (FIG. 4) and is separated from the rotational center $O_1$ (FIG. 4) of the crankshaft 23. A driven eccentric ring 26 is fitted rotatably on the crank portion 25.

An orbiting scroll 27 is provided with a cylindrical scroll shaft 28 on one surface of a base plate thereof and a wrap 39 on the other surface thereof. The scroll shaft 28, which is fitted rotatably on a driven eccentric ring 26, has a center $O_2$ on a line 33 (FIG. 4) which is separated by a predetermined crank radius r from a line 32 (FIG. 4) on which the rotational center $O_1$ of the crankshaft 23 lies. The eccentric ring 26 lies substantially on a line connecting the rotational center $O_1$ and the center $O_2$ of the orbiting scroll shaft 28 and rotates about, for example, the point $O_3$ on the line 31 which is opposite to the rotational center $O_1$ with respect to the center $O_2$. The ratio of the distance between $O_2$ and $O_3$ to that between $O_1$ and $O_2$ is from about one third to about one fifth and, for example, it may be set at about one fourth.

A thrust-cancelling shaft 29 in the form of a cylindrical pillar extends through an eccentric through-hole 30 formed in and along the crankshaft 23. The center (axial) line of the thrust-cancelling shaft 29 coincides with the center line 33 of the orbiting scroll shaft 28, at one end of which the orbiting scroll 27 is mounted.

In order to maintain the desired angular position of the orbiting scroll 27, a known Oldham coupling 34 is used. The Oldham coupling 34, which has the form of ring, is formed on one surface thereof with a pair of orthogonally arranged protrusions 38, and on the other surface with a pair of protrusions 36 extending orthogonal to each other and to the protrusions 38. The protrusions 36 on the other surface are received radially and slidably in Oldhams slots 35 formed in a portion of the housing 20, and those 38 on the one surface are received similarly in slots 37 formed in the orbiting scroll 27.

A stationary scroll 40 having a scroll wrap 41 is secured by bolts 42 to the housing 20 such that the scroll wrap 41 thereof is interleaved with the scroll 39 of the orbiting scroll 27 in the relationship shown in FIG. 1. Tip seal members 43 and 44 are force fitted in edge portions of the scroll wraps 39 and 41, respectively, sealing radial gaps between these wraps.

An intake port 45 is formed in the housing 20 to which an intake pipe 46 is connected. When the orbiting scroll 27 orbits with respect to the stationary scroll 40, fluid is introduced through the pipe 46 and the port 45 to a suction chamber 47, and then to the compression chamber 48 where it is compressed and finally discharged through a discharge port 49 and a discharge pipe 50 connected thereto. An arrow in FIG. 3 shows the direction of flow of the fluid.

A balance weight 51 is fixedly secured to the rotor 22 to balance the centrifugal force of the orbiting scroll which is generated during the operation of the machine.

On the side of the one end of the thrust cancelling shaft 29, a first fluid volume changing mechanism composed of the stationary scroll 40 and the orbiting scroll 27, the Oldham coupling 34, the crank mechanism composed of the crank portion 25 and one end of the crankshaft 30 and the driven eccentric ring 26, etc. are disposed, and, on the side of the other end of the thrust-cancelling shaft 29, a second fluid volume changing mechanism composed of a stationary scroll 140 and an orbiting scroll 127, an Oldham coupling similar to the Oldham coupling 34, a crank mechanism composed of a crank portion 125 and the other end of the crankshaft 30 and a driven eccentric ring 126, etc. are arranged having a mirror-image relationship to the components arranged on the side of the one end of the thrust-cancelling shaft.

In operation, assuming the machine is operating as a compressor, when the stator 21 is energized, the rotor 22 is rotated to drive the crankshaft 23. The rotation of the crankshaft 23 is transmitted through the crank portion 25 and the eccentric ring 26 to the orbiting scroll shaft 28 to move the orbiting scroll 27 with respect to the stationary scroll 40 as shown in FIG. 1, with the angular position thereof being restricted by the Oldham coupling 34 to thereby perform a compression operation. Gas to be compressed is continuously introduced through the intake pipe 46, and compressed gas is discharged through the discharge pipe 50.

The function of the eccentric ring 26 will be described in detail. In summary, the eccentric ring 26 functions, with the aid of gas pressure acting on the orbiting scroll 27 and/or the centrifugal force thereof, to increase the orbital radius of the orbiting scroll 27 until the scroll wrap 39 of the orbiting scroll 27 comes into contact with the wrap 41 of the stationary scroll 40, thereby to seal the radial gaps between the scroll wraps 39 and 41 and thus eliminate gas leakage radially through the gap and accordingly improve the compression efficiency. The tip seals 43 and 44 function to prevent gas leakage through gaps between the base plates of the scrolls 27 and 40 and the edge portions of the wraps thereof.

The above operations and effects are the same for the mechanism provided around the other end of the thrust-cancelling shaft 29.

The centrifugal force due to the mass of the orbiting scroll 27 is balanced by the balance weight 51 provided on the rotor 22.

Figure 5:
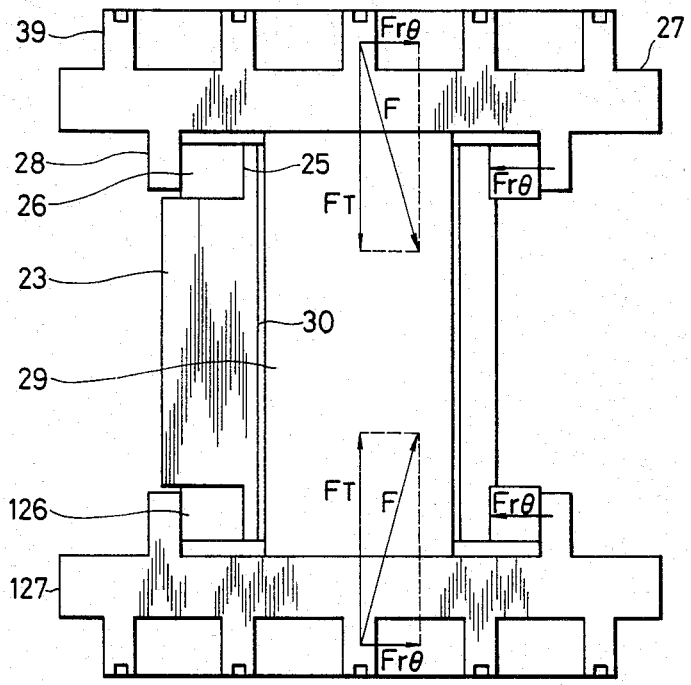
FIG. 5 is a diagram illustrating the relationship between the orbiting scrolls and thrust cancelling shaft.

When the compression operation commences as mentioned above, a radial force $F_{r\theta}$ (tangential+centrifugal force) and a thrust force $F_T$ act on the orbiting scroll 27 as shown in FIG. 5, with the composite force thereof being designated by F. The radial forces $F_{r\theta}$ is transmitted through the eccentric ring 26 and the crankshaft 23 to the bearing 24 in the housing 20. The thrust force $F_T$ is transmitted to the thrust cancelling shaft 29 disposed in the eccentric through-hole 30 of the crankshaft 23. With orbiting scrolls 27 and 127 provided at the opposite ends of the thrust-cancelling shaft 29 in a mirror-image relationship, the thrust forces $F_T$ acting on the opposite ends thereof are the same in magnitude and the position at which they act. Thus, these forces cancel out one another through the thrust-cancelling shaft 29.

It is very important that there be no moment produced about the thrust-cancelling shaft 29. The thrust-cancelling shaft 29 is separately provided from the orbiting scroll 27. However, since there is no substantial relative movement between the the thrust cancelling shaft 29 and the orbiting scroll 27 (only a minute moment due to the radial sealing of the orbiting scroll), and since they rotate with the same orbital radius, the thrust-cancelling shaft 29 moves together with the orbiting scroll 27. Assuming the distance between the lines along which the radial forces of the orbiting scroll 27 and the eccentric ring 26 act as l, a moment $F_{r\theta} \cdot l$ is produced by the force $F_{r\theta}$. This moment must be balanced. Therefore, the relationship $F_T \cdot n = F_{r\theta} \cdot l$ is established, where n is the distance between the line along which the anti-thrust force $F_T$ acts and the center line of the thrust-cancelling shaft 29. Therefore, $$n = \frac{F_{r\theta}}{F_T} \cdot l.$$

It is preferable to make the radius of the thrust-cancelling shaft 29 larger than n. Otherwise, the orbiting scroll 27 tends to turn about a fulcrum point on the outer periphery of the thrust-cancelling shaft 29.

The radial sealing effect provided by the eccentric ring 26 will be described with reference to FIGS. 6 and 7.

Figure 6:
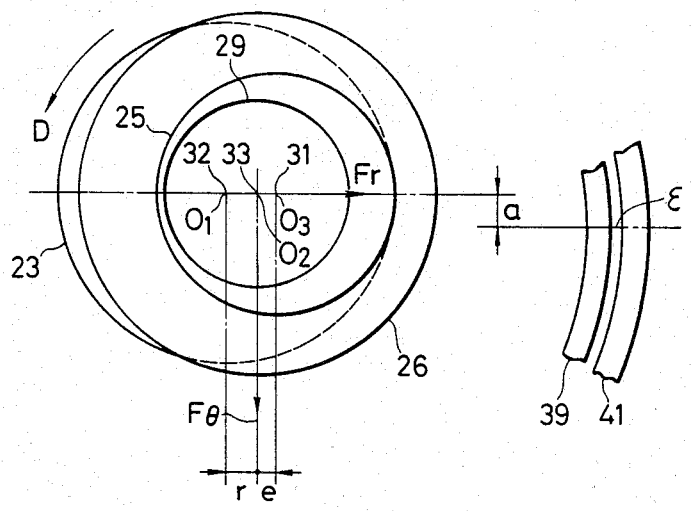
FIGS. 6 and 7 illustrate a driven eccentric ring mechanism in successive operational steps, used for explaining the operation thereof.
Figure 7:
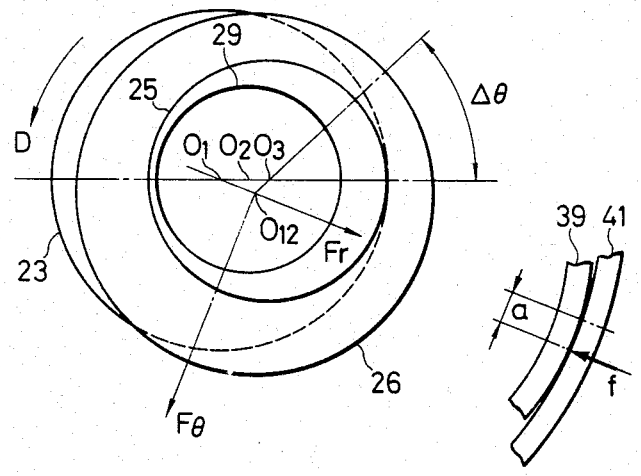

It is well known that when the compression operation commences a force $F_\theta$ tangential to the rotating direction D, which acts a load on the driving source, and a radial force $F_r$, due mainly to the centrifugal force of the orbiting scroll 27, act on the center $O_2$ of the orbiting scroll shaft 28, as shown in FIG. 6. When the force $F_\theta$ acts on the center $O_2$, a moment $F_\theta \cdot e$ is produced around the center $O_3$ of the eccentric ring 26, where e is the distance between the centers $O_2$ and $O_3$. Since the force component $F_r$ acts on a line connecting the centers $O_2$ and $O_3$, there is no moment produced by the force component $F_r$. Even when the distance r between the points $O_1$ and $O_2$ is maintained at a value equal to the predetermined crank radius, there may be a minute gap $\epsilon$ between the wraps 39 and 41 of the orbiting scroll 27 and the stationary scroll 40. It has empirically determined that the width of the gap $\epsilon$ is about several microns to several decades of microns. Assuming that each of the wraps 39 and 41 is constituted by involutes of a circle having a radius a, the minimum gap $\epsilon$ must lie on straight lines parallel to the direction in which acts the force $F_r$ on both sides thereof and which are separated by a.

Due to the moment $F_\theta \cdot e$ produced around the center $O_3$ of the eccentric ring 26, the center $O_2$ of the orbiting scroll shaft 28 rotates around the center $O_3$ so that the scroll wrap 39 of the orbiting scroll approaches the wrap 41 of the stationary scroll 40 and contacts therewith, closing the gap $\epsilon$. This state is shown in FIG. 7 in which the center $O_2$ of the orbiting scroll shaft 28 rotates around the point $O_3$ by a minute angle $\Delta\theta$ to a position $O_{12}$. At this time, the distance between $O_1$ and $O_2$ is increased to a value equal to the distance between $O_1$ and $O_{12}$ to thus make the gap $\epsilon$ between the wraps 39 and 41 zero in width. As shown in FIG. 7, a sealing force f is accordingly produced between the wraps.

Taking the facts that the gap $\epsilon$ is very small in length and thus that the rotational angle $\Delta\theta$ is also small into consideration, the relationship $2f \cdot a = F_\theta \cdot e$ is established by the balance of moments, where e is the distance between the center $O_2$ and $O_3$ (The wraps contacts at least at two points.). Thus the sealing force is $f = (e/2a) \cdot F_\theta$. With this force, the radial sealing of the wraps 39 and 41 of the orbiting scroll 27 and the stationary scroll 40 is realized and the leakage of compressed fluid minimized during the operation of the machine.

A feature of the eccentric ring 26 of this embodiment is that the sealing force f is a function of only the tangential force component $F_\theta$, which is determined only by the pressure distribution in the compressor and is not influenced substantially by the rotational speed or the centrifugal force of the orbiting scroll 27. However, in a case where some influence of this centrifugal force is acceptable, it is possible to shift the center $O_3$ of the eccentric ring 26, and hence the crank portion 25, from the line connecting the centers $O_1$ and $O_2$. In this case, radial gap sealing between the scroll wraps 39 and 41 is also realized by the eccentric ring 26.

The movement of the orbiting scroll 27 performing such radial sealing is a relative movement of the thrust-cancelling shaft 29 and the orbiting scroll 27. However, the function of this movement is only to close the minute gap $\epsilon$ between the scroll wraps 39 and 41 of the orbiting scroll 27 and the stationary scroll 40, and thus the amount of this movement is very small.

It is possible to rotatably fit the orbiting scroll shaft 28 directly on the crank portion 25 without using the eccentric ring. In such a case, the sealing of the radial gap may be neglected.

In the embodiment described hereinbefore, an electric motor is used as the driving source. It should be noted, however, that instead of an electric motor, an external driving source may be used together with gears and pulleys.

As mentioned hereinbefore, according to the present invention, fluid volume changing mechanisms, each including a stationary scroll and an orbiting scroll, are arranged at opposite end portions of a crankshaft. With this arrangement, the adjustment of the assembly of each fluid volume changing mechanism can be performed separately and easily. Further, since a thrust-cancelling shaft is provided on which thrust forces exerted on the orbiting scrolls act in opposite directions, with a minimum relative movement between the orbiting scrolls and the thrust-cancelling shaft, the thrust forces cancel out each other, and thus the mechanical reliability of the machine is improved.

Furthermore, since the orbiting scrolls are driven by a crank mechanism through respective eccentric rings, the assembly operation of the orbiting scrolls to the stationary scrolls is facilitated.

I claim:

1. A scroll-type hydraulic machine, comprising:

a first fluid volume changing mechanism comprising a first stationary scroll having a first scroll wrap, and a first orbiting scroll having on one surface thereof a second scroll wrap and on the other surface thereof a first orbiting scroll shaft, said first orbiting scroll being assembled with said first stationary scroll such that, when said second scroll wrap orbits with respect to said first scroll wrap, fluid introduced therebetween is changed in volume and discharged;

a second fluid volume changing mechanism comprising a second stationary scroll having a third scroll wrap, and a second orbiting scroll having on one surface thereof a fourth scroll wrap and on the other surface thereof a second orbiting scroll shaft, said second orbiting scroll being assembled with said second stationary scroll such that, when said fourth scroll wrap orbits with respect to said third scroll wrap, fluid introduced therebetween is changed in volume and dischanged;

a crank mechanism comprising a crankshaft having an eccentric through-hole extending therethrough, a first crank portion formed at one end thereof for rotatably supporting said first orbiting scroll shaft, and a second crank portion formed at the other end thereof for rotatably supporting said second orbiting scroll; and a thrust-cancelling shaft disposed in said eccentric through-hole of said crankshaft for supporting at one end thereof said first orbiting scroll and at the other end thereof said second orbiting scroll, thrust forces exerted on said first and second orbiting scrolls cancelling each other through said thrust-cancelling shaft.

2. The scroll-type hydraulic machine as claimed in claim 1, wherein said crank mechanism further comprises a first driven eccentric ring disposed between said first crank portion of said crankshaft and said first orbiting scroll shaft for rotatably supporting said first orbiting scroll shaft, and a second driven eccentric ring disposed between said second crank portion of said crankshaft and said second orbiting scroll shaft for rotatably supporting said second orbiting scroll shaft.

3. The scroll-type hydraulic machine as claimed in claim 1, wherein said first and second fluid volume changing mechanisms are provided in a mirror-image relationship.

4. The scroll-type hydraulic machine as claimed in claim 2, wherein said first and second fluid volume changing mechanisms are provided in a mirror-image relationship.

5. The scroll-type hydraulic machine as claimed in claim 1, wherein a tip seal member is provided on an edge portion of each of said first, second, third and fourth scroll wraps.

* * * * *